US006360733B1

(12) United States Patent
Uberti Bona Blotto et al.

(10) Patent No.: US 6,360,733 B1
(45) Date of Patent: Mar. 26, 2002

(54) SELF-ADAPTING METHOD OF CONTROLLING THE MIXTURE RATIO OF AN INTERNAL COMBUSTION ENGINE INJECTION SYSTEM

(75) Inventors: Marco Uberti Bona Blotto, Biella; Luca Poggio, Spinetta Marengo; Marco Secco, Nizza Monferrato; Giorgio Bombarda, S. Lazzaro di Savena, all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/503,521

(22) Filed: Feb. 14, 2000

(30) Foreign Application Priority Data

Feb. 19, 1999 (IT) ..... T099A0128

(51) Int. Cl.[7] ..... F02D 41/14
(52) U.S. Cl. ..... 123/674; 123/486; 123/689
(58) Field of Search ..... 123/674, 675, 123/686, 689, 486; 701/106, 109

(56) References Cited

U.S. PATENT DOCUMENTS 4,676,215 A * 6/1987 Blocher et al. ..... 123/674 X
4,854,287 A * 8/1989 Tomisawa ..... 123/675
4,901,240 A 2/1990 Schmidt et al. ..... 701/106
5,033,437 A * 7/1991 Hori et al. ..... 123/674
5,126,943 A * 6/1992 Nakaniwa ..... 123/673 X
5,464,000 A * 11/1995 Pursifull et al. ..... 123/674
5,483,946 A * 1/1996 Hamburg et al. ..... 123/686
5,564,406 A 10/1996 Klein ..... 123/681

FOREIGN PATENT DOCUMENTS

EP 0281962 9/1988
EP 0423376 4/1991
EP 0451295 10/1991

* cited by examiner

*Primary Examiner*—Tony M. Argenbright
(74) *Attorney, Agent, or Firm*—Ladas & Parry

(57) ABSTRACT

A self-adapting method of controlling the mixture ratio of an injection system, of an internal combustion engine. In each operating state of the engine and for each injector, the method determines a nominal quantity of fuel to be injected as a function of a number of engine parameters and operating conditions, an operating parameter as a function of a signal representing exhaust gas composition and of a proportional-integral regulating function and hot and cold correction coefficients indicating a correction to be made to the nominal quantity of fuel to take into account the effect on injection of different engines and different injection systems during hot and cold engine operation.

19 Claims, 5 Drawing Sheets

SELF-ADAPTING METHOD OF CONTROLLING THE MIXTURE RATIO OF AN INTERNAL COMBUSTION ENGINE INJECTION SYSTEM

The present invention relates to a self-adapting method of controlling the mixture ratio of an internal combustion engine injection system.

BACKGROUND OF THE INVENTION

As is known, the injection systems of many currently marketed vehicles feature a mixture ratio control system based on a self-adapting strategy designed to ensure supply of the amount of fuel required to obtain an exhaust ratio equal to an objective ratio, to compensate for any production differences causing the engine and injection system to deviate from the nominal on which the settings are based, to compensate for in-life component drift and ageing which might affect the control system, and to supply useful information concerning the state of the components with a view to diagnosing the injection system.

Currently used self-adapting algorithms are based on the assumption that any differences or malfunction which might affect correct preparation of the air/fuel mixture can be traced to an error in the injector actuation characteristic defined by the relationship between injection time and the amount of fuel injected.

In the injection central control unit, the above characteristic is approximated by a line defined by two parameters: gain and offset, i.e. by the slope and initial value with respect to a predetermined reference system.

According to the above self-adapting algorithms, errors due to production variations and ageing can be traced to errors in estimating the set gain and offset.

The adaptive gain and offset parameters are applied in all engine operating conditions, except for start-up, and are only updated in steady operating conditions of the engine.

The two adaptive parameters are not updated simultaneously, but according to a precise operating sequence. That is, keeping the gain value fixed, offset updating is enabled within a particular stabilized-engine window close to the idling condition; once offset is updated, the gain value is corrected in another stabilized-engine window corresponding to a high speed and load situation; and the sequence is repeated to obtain a real value by successive approximations.

Though widely used in the automotive industry, the above strategy has the major drawback of being intrinsically very slow in adapting.

SUMMARY OF THE INVENTION

It is an object of the present invention to provide a self-adapting mixture ratio control method designed to eliminate the aforementioned drawbacks.

According to the present invention, there is provided a self-adapting method of controlling the mixture ratio of an injection system, of an internal combustion engine, comprising a number of injectors, each for injecting a respective operating quantity of fuel at each engine cycle; and a stoichiometric composition sensor generating a composition signal related to the stoichiometric composition of the exhaust gases produced by said engine; in each operating state of the engine and for each said injector, said method comprising the steps of:

a) determining a nominal quantity of fuel to be injected;

b) determining an operating parameter as a function of said composition signal and of a proportional-integral regulating function; characterized by also comprising the steps of:

c) determining a current hot correction coefficient indicating a correction to be made to said nominal quantity of fuel to take into account the effect on injection of differences of different engines and of said injection systems thereof upon the engine reaching normal operating temperatures; and d) determining said operating quantity of fuel to be injected as a function of said nominal quantity, of said operating parameter, and of said current hot correction coefficient.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
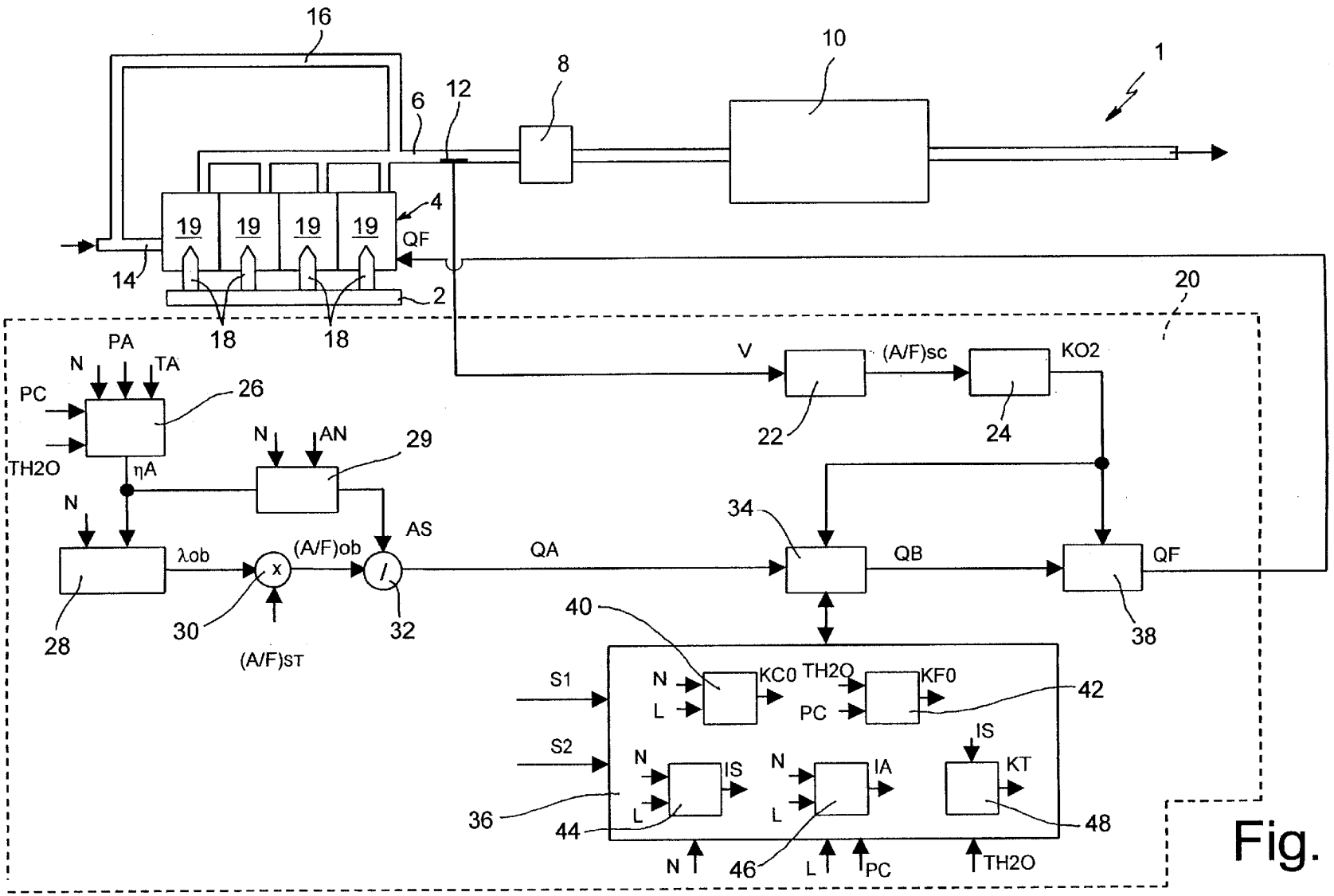
FIG. 1 shows, schematically, a mixture ratio control system in accordance with the present invention.

Number 1 in FIG. 1 indicates as a whole a system for controlling the mixture ratio of an injection system 2 of an internal combustion engine 4.

Engine 4 comprises an exhaust manifold 6 along which are fitted a catalytic preconverter 8, a catalytic converter 10 located downstream from catalytic preconverter 8, and an exhaust gas stoichiometric composition sensor 12 located upstream from catalytic preconverter 8 and generating a composition signal V related to the stoichiometric composition of the exhaust gases.

The stoichiometric composition sensor 12 may be an ON/OFF so-called LAMBDA sensor, in which case, a digital two-level composition signal V is generated indicating a rich or lean stoichiometric composition of the exhaust gases; or a proportional so-called UEGO sensor, in which case, an analog composition signal V is generated indicating the point stoichiometric composition of the exhaust gases.

Engine 4 also comprises an air intake manifold 14; and an exhaust gas recirculation system 16—hereinafter referred to as EGR system and shown schematically by a conduit connecting exhaust and intake manifolds 6, 14—for feeding part of the exhaust gases in exhaust manifold 6 back into intake manifold 14 to reduce the combustion temperature and the formation of nitric oxides (NOx).

In the example shown, injection system 2 is a direct injection type, and comprises a number of injectors 18, each relative to a respective cylinder 19 of engine 4, and each for injecting, at each engine cycle, a respective quantity of fuel into the relative cylinder 19.

What is said concerning injection system 2 obviously also applies to an indirect injection system, in which the injectors 18 are arranged along intake manifold 14.

Control system 1 also comprises a central control unit 20 for receiving a number of engine parameters, measured on engine 4 by means of appropriate sensors (not shown), and a number of operating parameters, and for generating, at each engine cycle, the operating quantity QF of fuel to be injected by each injector 18 into the relative cylinder 19 at each engine cycle.

More specifically, central control unit 20 receives: the speed N of engine 4; the load L of engine 4; the stoichiometric ratio $(A/F)_{ST}$ for injection; nominal air flow AN; the air temperature TA in intake manifold 14; the cooling water temperature TH2O; atmospheric pressure PA; the pressure PC in intake manifold 14; the operating state S1 of EGR system 16 (on/off); and the operating state S2 of the ratio control performed by stoichiometric composition sensor 12 (open-loop/closed-loop control).

Operating state S1 of EGR system 16 and the ratio control state S2 may be determined, for example, by reading the logic states of respective appropriately memorized logic flags.

The operating quantity QF of fuel to be injected into each cylinder of engine 4 at each engine cycle is supplied each time to injection system 2 to effect injection using an injector actuation characteristic having fixed gain and offset parameters.

Central control unit 20—of which only the parts essential to a clear understanding of the present invention are shown—comprises a signal processing block 22 connected at the input to stoichiometric composition sensor 12, and generating the exhaust ratio $(A/F)_{SC}$ at each engine cycle.

More specifically, in signal processing block 22 is memorized the characteristic of stoichiometric composition sensor 12 (LAMBDA or UEGO) by which the $(A/F)_{SC}$ values are determined as a function of the amplitude of composition signal V.

Central control unit 20 also comprises a proportional-integral control block 24—known and therefore not described in detail—for receiving the $(A/F)_{SC}$ values generated by the signal processing block, and for generating, at each engine cycle, the value of a control parameter KO2 used for controlling the ratio as described in detail later on.

More specifically, the values of control parameter KO2 supplied by control block 24 vary as a function of the composition signal supplied by stoichiometric composition sensor 12, and oscillate about a mean value of about one, if engine 4 and injection system 2 have no deviations, and about a mean value of other than one, if engine 4 and injection system 2 do have deviations.

Central control unit 20 also comprises a first calculating block 26, which receives atmospheric pressure PA, the air temperature TA in intake manifold 14, cooling water temperature TH2O, the speed N of engine 4 and the pressure PC in intake manifold 14, and which generates, at each engine cycle, an intake efficiency ηA indicating, as is known, the potential capacity of intake manifold 14 to fill the combustion chamber of each cylinder with a fresh charge.

More specifically, in first calculating block 26 is memorized an electronic map containing a respective intake efficiency value ηA for each combination of values PA, TA, TH2O, N and PC.

Central control unit 20 also comprises a second calculating block 28, which receives the speed N of engine 4 and intake efficiency ηN, and which generates, at each engine cycle, an objective value $\lambda_{OB}$ equal to the ratio between the objective ratio $(A/F)_{OB}$ desired for injection and the stoichiometric ratio $(A/F)_{ST}$, i.e.

$$\lambda_{OB} = \frac{(A/F)_{OB}}{(A/F)_{ST}}$$

More specifically, in second calculating block 28 is memorized an electronic map containing a respective objective value $\lambda_{OB}$ for each combination of the speed N and intake efficiency ηA values.

Central control unit 20 also comprises a third calculating block 29, which receives intake efficiency ηA, speed N and nominal air flow AN, and which generates, at each engine cycle, a respective air intake AS.

Central control unit 20 also comprises a multiplying block 30, which receives objective value $\lambda_{OB}$ and a stoichiometric ratio $(A/F)_{ST}$, typically equal to 14.56, and which generates, at each engine cycle, objective ratio $(A/F)_{OB}$ according to the equation:

$$(A/F)_{OB}=\lambda_{OB}\cdot(A/F)_{ST}$$

Central control unit 20 also comprises a dividing block 32, which receives objective ratio $(A/F)_{OB}$ and air intake AS, and which generates, at each engine cycle, a nominal quantity QA of fuel to be injected according to the equation:

$$QA = \frac{AS}{(A/F)_{OB}}$$

Central control unit 20 also comprises a third calculating block 34, which receives the nominal quantity QA of fuel to be injected, speed N, load L and the cooling water temperature TH2O of engine 4, and which generates, at each engine cycle, a corrected quantity QB of fuel to be injected according to the equation:

$$QB=QA\cdot KCO\cdot KFO$$

where KCO is a first correction coefficient, hereinafter referred to as current hot correction coefficient, which is a function of the operating state of engine 4 defined by speed N and load L of engine 4; and KFO is a second correction coefficient, hereinafter referred to as current cold correction coefficient, which is a function of cooling water temperature TH2O and pressure PC in intake manifold 14.

More specifically, third calculating block 34 performs a double correction of the nominal quantity QA of fuel to be injected using current hot correction coefficient KCO, which provides for hot correction of nominal fuel quantity QA, i.e. with engine 4 at normal operating temperatures, to take into account the effect on injection of deviations of engine 4 and injection system 2, and using current cold correction coefficient KFO, which provides for cold correction of nominal fuel quantity QA, i.e. before engine 4 reaches normal operating temperatures, to take into account the effect on injection of low temperatures, at which engine 4 is difficult to calibrate.

More specifically, third calculating block 34 cooperates with a memory block 36 in which are memorized five electronic maps: two containing the values of current hot and cold correction coefficients KCO and KFO; and three containing information used by central control unit 20 to update correction coefficients KCO and KFO, as explained in detail later on.

Central control unit 20 also comprises a fourth calculating block 38, which receives the corrected quantity QB of fuel to be injected, and which generates, at each engine cycle, an operating quantity QF of fuel to be injected according to the equation:

$$QF=QB\cdot KO2=QA\cdot KCO\cdot KFO\cdot KO2$$

where KO2 is the control parameter supplied by proportional-integral control block 24.

More specifically, fourth calculating block 38 performs a further correction of the nominal quantity QA of fuel to be injected using control parameter KO2, which takes into account the exhaust ratio information supplied by stoichiometric composition sensor 12.

The operating quantity QF of fuel to be injected is then supplied to injection system 2, which uses this value to determine the injection time of the injectors as a function of the injector actuation characteristic, and so inject the operating quantity QF of fuel into each cylinder.

Unlike known control systems, in which central control unit 20 only determines the operating quantity QF of fuel to be injected by each injector 18 at each engine cycle as a function of nominal quantity QA and operating parameter KO2, according to a first aspect of the present invention, central control unit 20 therefore also determines the operating quantity QF of fuel to be injected as a function of current hot correction coefficient KCO and current cold correction coefficient KFO.

As stated, memory block 36 stores five electronic maps, namely:

- a first electronic map—hereinafter referred to as hot correction map 40—containing a respective current hot correction coefficient KCO for each operating state of engine 4 defined by a respective pair of speed N and load L values;
- a second electronic map—hereinafter referred to as cold correction map 42—containing a respective current cold correction coefficient KFO for each operating state of engine 4 defined by a respective pair of values of cooling water temperature TH2O and pressure PC in intake manifold 14;
- a third electronic map—hereinafter referred to as engine state map 44—containing a respective engine state flag Is for each operating state of engine 4 defined by a respective pair of speed N and load L values;
- a fourth electronic map—hereinafter referred to as update state map 46—containing a respective update state flag IA for each operating state of engine 4 defined by a respective pair of speed N and load L values; and
- a fifth electronic map—hereinafter referred to as transition map 48—containing a number of transition coefficients KT as a function of engine state flags IS, as described in detail later on.

More specifically, the above electronic maps are defined by respective two-dimensional matrixes of the same dimensions (i.e. having the same number of rows and columns, and therefore the same number of boxes), and wherein each box is identified by a respective pair of input parameter values (speed N and load L for the first, third and fourth map, and cooling water temperature TH2O and pressure PC for the second) and relates to a respective value of the parameter memorized in it.

It should be pointed out that the values relating to boxes in the same position (i.e. in the same row and column) in hot correction map 40, cold correction map 42, engine state map 44 and update state map 46 are related to one another by relating to the same engine state.

More specifically, ink hot correction map 40, all the current hot correction coefficients KCO are set to a unit value at the initial calibration stage of engine 4, seeing as no nominal fuel injection quantity QA correction relative to deviations of the engine 4 and injection 2 parameters is requited initially.

In cold correction map 42, on the other hand, the current cold correction coefficients KFO are set to a unit value for cooling water temperature TH2O values above a predetermined threshold value, e.g. 60°, seeing as no correction relative to the operating temperature of engine 4 is required once engine 4 has reached normal operating temperatures.

In engine state map 44, each engine state flag IS may assume a number of values, each representing a respective operating mode of engine 4 in the relative engine state. More specifically, each state flag IS may assume the following values:

IS=0 if engine 4 is in operating states which are only reached in sharp transients and with the EGR system off;

IS=1 if engine 4 is in normal operating states with the EGR system off;

IS=2 if engine 4 is in the idling state with the EGR system off;

IS=3 if engine 4 is in motoring-over states with the EGR system off;

IS=4 if engine 4 is in full-load operating states with the EGR system off;

IS=5 if engine 4 is in operating states with open-loop ratio control;

IS=10 if engine 4 is in operating states which are only reached in sharp transients and with the EGR system on;

IS=11 if engine 4 is in normal operating states with the EGR system on;

IS=13 if engine 4 is in motoring-over states with the EGR system on;

IS=14 if engine 4 is in full-load operating states with the EGR system on.

Figure 2A:
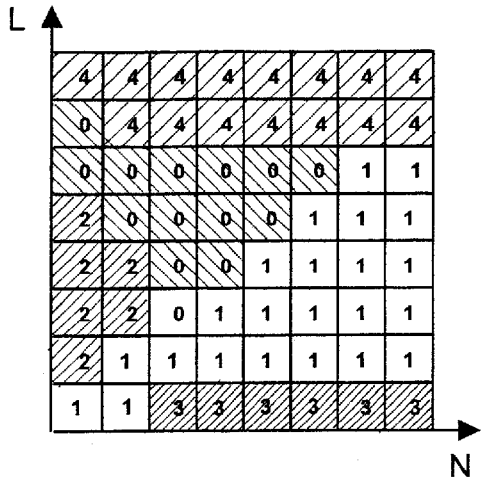
FIGS. 2*a,* 2*b* and 3*a,* 3*b* show engine state matrixes.
Figure 2B:
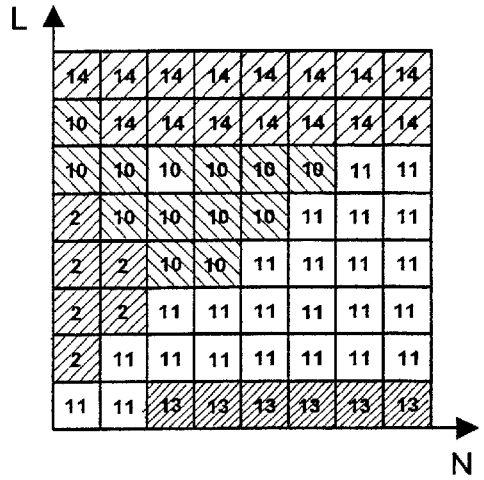
Figure 3A:
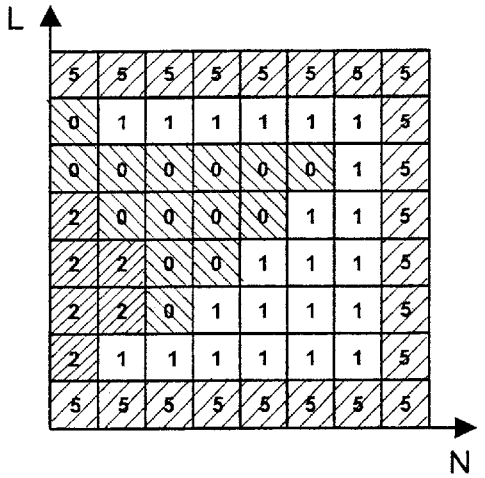
Figure 3B:
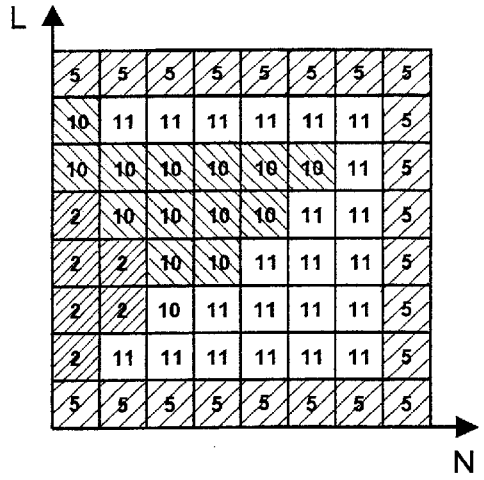

FIGS. 2*a* and 2*b* show the engine state maps for a UEGO sensor with the EGR system on and off respectively; and FIGS. 3*a* and 3*b* show the same engine state maps for a LAMBDA sensor.

As shown in the maps, the state flags IS memorized in a given engine state map do not assume all the above values indifferently, but only given subgroups of values depending on the operating state of EGR system 16 and the ratio control state.

As shown in the above Figures, the groups of engine state flags with the same values define in the matrixes respective zones which, though geometrically close, are physically very far apart as regards operation of the engine, and each of which indicates a respective operating mode of engine 4, which is used to update hot and cold correction maps 40, 42 as explained in detail later on.

As can also be seen, the IS=5 value is only present in the engine state map 44 relating to a LAMBDA sensor.

The type of engine state map 44 used to update hot and cold correction maps 40, 42 is selected from those in FIGS. 2*a* and 2*b*, or from those in FIGS. 3*a* and 3*b*, by central control unit 20 on the basis of the logic value of flag S1 indicating the operating state (on/off) of EGR system 16, which is defined at the calibration stage of engine 4.

The logic value of flag S2 indicating the ratio control operating state (open/closed loop), on the other hand, is used by the central control unit to identify the IS=5 zone in the LAMBDA sensor engine state map 44.

In update state map 46, each update state flag IA may assume a number of values, each representing the update state of a corresponding hot correction coefficient, i.e. the hot correction coefficient relating to the same engine state. More specifically, each update state flag IA may assume values IA=0, IA=1, IA=2, IA=3 and IA=4 on the basis of the update criterion described later on with reference to the state diagram in FIG. 6.

It should be pointed out that the values of the boxes in hot correction map 40, engine state map 44 and update state map 46 are so related that each current hot correction coefficient value KCO is related to a corresponding engine state flag IS and a corresponding update state flag IA.

Transition map 48, on the other hand, contains a number of transition coefficients KT(i,j), each of which, as described in detail later on, is used to propagate an update from a first hot correction coefficient with a first state flag IS, to a second hot correction coefficient with a second state flag IS. For which reason, each transition coefficient is hereinafter indicated by the letters KT followed by two numbers separated by a comma, enclosed in brackets, and indicating said first and second state flag IS.

For example, transition coefficient KT(3,2) propagates the update of a hot correction coefficient with a state flag IS of value 3 to a hot correction coefficient with a state flag IS of value 2.

According to a further aspect of the present invention, central control unit 20 implements the operations described below with reference to the FIG. 4 and 5 flow charts to continually update hot and cold correction maps 40, 42 using engine state map 44, update state map 46 and transition map 48 as described in detail below.

Figure 4:
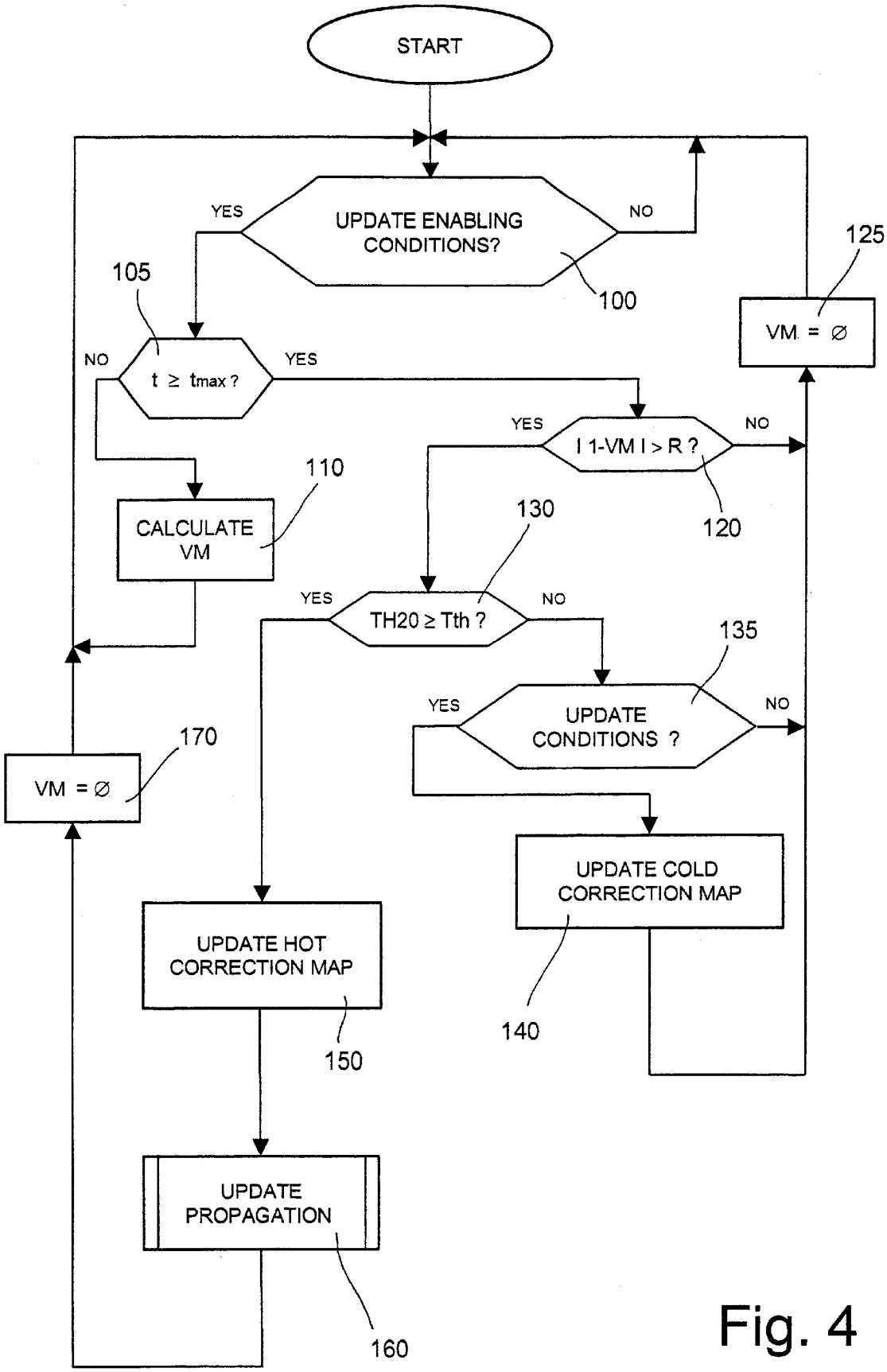
FIGS. 4 and 5 show operating block diagrams of the control method according to the present invention.

As shown in FIG. 4, to begin with, in a block 100, third calculating block 34 determines the existence of engine 4 and injection system 2 operating conditions permitting updating of the hot and cold correction maps.

More specifically, the operating conditions of engine 4 and injection system 2 permitting updating of the maps are as follows: the map update function has been enabled at the calibration stage; third calculating block 34 is enabled for updating; there are no faults in control system 1; start-up of engine 4 is terminated; feedback injection control using stoichiometric composition sensor 12 is active; and the following update stability conditions are determined: the system is in stabilized or idling engine mode, i.e. air supply A is constant and engine 4 is at steady speed; and stoichiometric composition sensor 12 is operating, i.e. if a LAMBDA sensor is used, n (calibration) switchings of the sensor have occurred, or, if a UEGO sensor is used, the difference between the sensor-detected A/F value and objective value $(A/F)_{OB}$ is below a calibration threshold.

The existence of update enabling conditions may be determined, for example, by reading the logic states of relevant logic flags.

If the operating conditions of engine 4 and injection system 2 permit updating of the maps (YES output of block 100), block 100 goes on to a block 105. Conversely, if the operating conditions of engine 4 and injection system 2 do not permit updating of the maps (NO output of block 100), block 100 goes back to its own input pending such conditions.

Block 105 determines whether the elapsed time t, since the existence of operating conditions of engine 4 and injection system 2 permitting updating of the maps, is greater than or equal to a predetermined maximum time tMAX, e.g. six seconds.

If elapsed time t is greater than or equal to maximum time tMAX (YES output of block 105), block 105 goes on to a block 120. Conversely, if elapsed time t is less than maximum time tMAX (NO output of block 105), block 105 goes on to a block 110.

In block 110, third calculating block 34 determines an operating value VM, equal to the mean value of the control parameter KO2 values generated by control block 24 since the above conditions were determined, using a known low-pass numeric filter not described in detail. Obviously, the first time block 110 is reached, operating value VM equals the first calculated value of control parameter KO2.

Block 110 then goes back to block 100 to determine the existence of engine 4 and injection system 2 operating conditions permitting updating of the maps.

Central control unit 20 therefore repeatedly calculates a new operating value VM as a function of the control parameter KO2 values generated by control block 24 within a time window of a duration TMAX from the instant in which the above operating conditions are determined.

If, within the time window in which operating value VM is calculated, the operating conditions of engine 4 and injection system 2 permitting updating of the maps cease to exist, e.g. because engine 4 is no longer at steady speed (NO output of block 100), block 100, since the calculated operating value VM is not reliable, goes back to its own input pending the above operating conditions to calculate a reliable operating value VM.

In block 120, which is reached when the above operating conditions exist for at least maximum time tMAX and so permit calculation of a reliable operating value VM, third calculating block 34 determines whether $|1-VM|>R$, where R is a predetermined threshold value, i.e. determines whether engine 4 and injection system 2 have dispersions calling for updating of the hot or cold correction map 40, 42.

As stated, in fact, the values of control parameter KO2 oscillate about a mean value of about 1, if engine 4 and injection system 2 have no dispersions, and about a mean value of other than 1, if engine 4 and injection system 2 do have dispersions.

If $|1-VM|>R$ (YES output of block 120), this means hot or cold correction map 40, 42 needs updating, and block 120 goes on to a block 130. Conversely, if $|1-VM|<R$ (NO output of block 120), this means hot or cold correction map 40, 42 does not need updating, and block 120 goes on to a block 125, which resets operating value VM and then goes back to block 100.

In block 130, third calculating block 34 determines whether the cooling water temperature TH2O is greater than or equal to a predetermined threshold value Tth, e.g. 60°.

If cooling water temperature TH2O is greater than threshold value Tth (YES output of block 130), block 130 goes on to a block 150. Conversely, if cooling water temperature TH2O is below threshold value Tth (NO output of block 130), block 130 goes on to a block 135.

In block 135, third calculating block 34 determines the existence of the following conditions:

the engine is idling; or the engine is at steady speed, and the update state flag IA relative to the current engine state is IA=1.

If the above conditions exist (YES output of block 135), cold correction map 42 can be updated, so block 135 goes on to a block 140. Conversely, if the above conditions do not exist (NO output of block 135), updating of cold correction map 42 is not advisable, so block 135 goes back to block 125, which in turn goes back to block 100.

In block 140, third calculating block 34 updates and memorizes cold correction map 42 in memory block 36, by selecting in the map the current cold correction coefficient KFO value relative to the cooling water temperature TH2O and the pressure PC in intake manifold 14 in the current engine state, and replacing it with an updated cold correction coefficient KFN equal to the current cold correction coefficient KFO memorized in cold correction map 42 multiplied by the mean value VM of the operating parameter KO2 calculated in block 110, i.e.:

$$KFN=KFO\cdot VM$$

The updated cold correction coefficient KFN therefore becomes the current cold correction coefficient KFO used in succeeding engine cycles to calculate the operating quantity QF of fuel to be injected.

Block 140 then goes back to block 125, which in turn goes back to block 100.

In block 150, third calculating block 34 updates and memorizes hot correction map 40 in memory block 36, by selecting the current hot correction coefficient KCO relative to the speed N and load L of engine 4 in the current engine cycle, and replacing it with an updated hot correction coefficient KFN equal to the current hot correction coefficient KCO memorized in hot correction map 40 multiplied by the mean value VM of the operating parameter KO2 calculated in block 110, i.e.:

$$KFN=KCO\cdot VM$$

The updated hot correction coefficient KFN therefore becomes the current hot correction coefficient KCO used in succeeding engine cycles to calculate the operating quantity QF of fuel to be injected.

Block 150 then goes on to a block 160, in which third calculating block. 34 propagates the block 150 update to other current hot correction coefficients KCO having a predetermined relationship with the updated hot correction coefficient KCN, as described in detail below with reference to the FIG. 5 flow chart.

Block 160 then goes on to a block 170, which resets value VM and then goes back to block 100.

In the following description of the update propagation operations in FIG. 5, the following terminology is used for the sake of clarity: the term "possible-update hot correction coefficients" and the symbol KCP refer to current hot correction coefficients KCO initially considered for possible update propagation; and the term "actual-update hot correction coefficients" and the symbol KCE refer to possible-update hot correction coefficients KCP which are actually to be updated.

Figure 5:
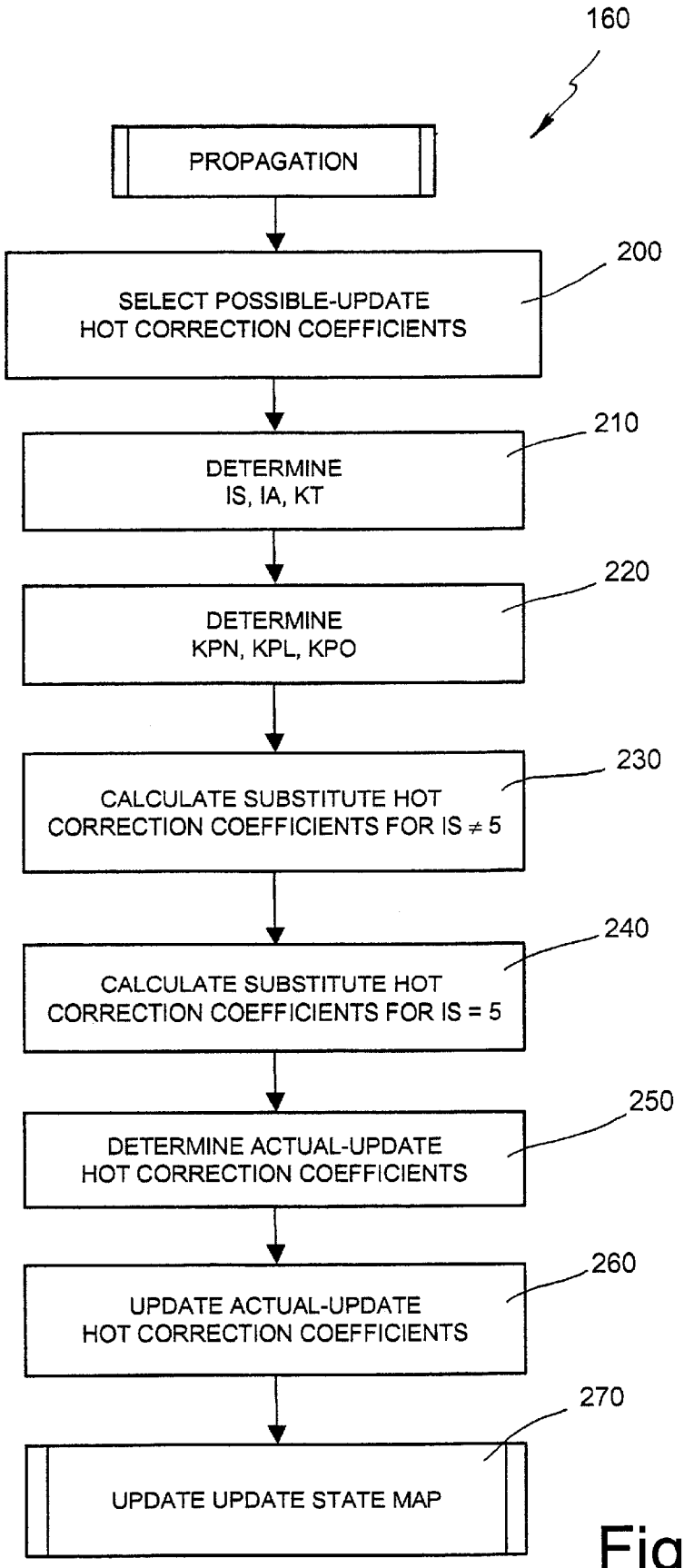

As shown in FIG. 5, to propagate the update, in a first block 200, third calculating block 34 selects, from the current hot correction coefficients KCO memorized in hot correction map 40, first possible-update hot correction coefficients KCP1 adjacent to the updated hot correction coefficient KCN, i.e. current hot correction coefficients KCO at a distance of one from the updated hot correction coefficient KCN, and defining a first frame of current hot correction coefficients KCO about the updated hot correction coefficient KCN.

In block 200, third calculating block 34 selects, from the current hot correction coefficients KCO memorized in hot correction map 40, second possible-update hot correction coefficients KCP2 adjacent to the first possible-update hot correction coefficients KCP1, i.e. current hot correction coefficients KCO at a distance of two from the updated hot correction coefficient KCN, and defining a second frame of current hot correction coefficients KCO about the first frame.

Figure 6:
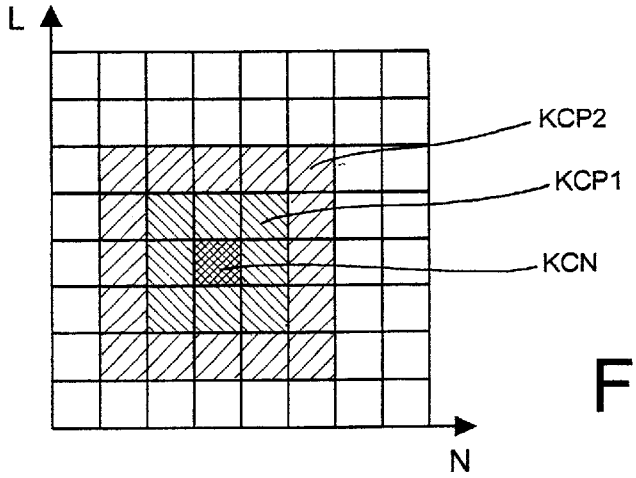
FIG. 6 shows an update propagation matrix.

FIG. 6 shows, with different crosshatching and the respective symbols indicated above, an updated hot correction coefficient KCN; the first frame about the updated hot correction coefficient KCN and defined by the adjacent first possible-update hot correction coefficients KCP1; and the second frame about the updated hot correction coefficient KCN and defined by the second possible-update hot correction coefficients KCP2 adjacent to the first possible-update hot correction coefficients KCP1.

Block 200 then goes on to a block 210, in which third calculating block 34 determines, for the updated hot correction coefficient KCN and for each of the possible-update hot correction coefficients KCP1, KCP2, a respective engine state flat IS in engine state map 44, and a respective update state flag IA in update state map 46.

In block 210, third calculating block 34 also determines, in transition map 48, the transition coefficients KT to use for propagating the update of updated hot correction coefficient KCN to possible-update hot correction coefficients KCP1, KCP2, i.e. the transition coefficients KT which each have, as engine state flags IS, the engine state flag relative to the updated hot correction coefficient KCN, and the engine state flag relative to the respective possible-update hot correction coefficient KCP1, KCP2.

Block 210 then goes on to a block 220, in which third calculating block 34 calculates, for each of the possible-update hot correction coefficient KCP1, KCP2 having engine state flag IS values of less than five, three propagation coefficients KPN, KPL, KPO for respectively propagating the update to possible-update shot correction coefficients KCP1, KCP2 in the same row as updated hot correction coefficient KCN, to possible-update hot correction coefficients KCP1, KCP2 in the same column as updated hot correction coefficient KCN, and to possible-update hot correction coefficients KCP1, KCP2 arranged obliquely with respect to updated hot correction coefficient KCN.

More specifically, for each possible-update hot correction coefficient KCP1, KCP2 in the same row as updated hot correction coefficient KCN $$\begin{cases} KPN(i,\ j) = K1\cdot KT(i,\ j)\cdot \dfrac{Nm}{Nd} \\ Nm = \dfrac{N\max - N\min}{n-1} \\ Nd = Nc - Np \end{cases} \quad 1)$$

where KPN(i,j) represents the propagation coefficient between the updated hot correction coefficient KCN having an engine state flag IS of value "i", and the possible-update hot correction coefficient KCP1, KCP2 having an engine state flag IS of value "j"; KT(i,j) is the transition coefficient between updated hot correction coefficient KCN and possible-update hot correction coefficient KCP1, KCP2; K1 is a first proportion coefficient memorized in third calculating block 34; n is the number of rows and columns in the matrix defining hot correction map 40; Nmax is the maximum engine speed in hot correction map 40; Nmin is the minimum engine speed in hot correction map 40; Nc is the engine speed relative to updated hot correction coefficient KCN; Np is the engine speed relative to possible-update hot correction coefficient KCP1, KCP2; Nd is the actual distance, in engine speed, between updated hot correction coefficient KCN and possible-update hot correction coefficient KCP1, KCP2; and Nm is the mean distance, in engine speed, between the current hot correction coefficients KCO memorized in hot correction map 40.

For each possible-update hot correction coefficient KCP1, KCP2 in the same column as updated hot correction coefficient KCN:

$$\begin{cases} KPL(i,\ j) = K2 \cdot KT(i,\ j) \cdot \dfrac{Lm}{Ld} \\ Lm = \dfrac{L\max - L\min}{n-1} \\ Ld = Lc - Lp \end{cases} \quad 2)$$

where KPL(i,j) represents the propagation coefficient between the updated hot correction coefficient KCN having an engine state flag IS of value "i", and the possible-update hot correction coefficient KCP1, KCP2 having an engine state flag IS of value "j"; KT(i,j) is the transition coefficient between updated hot correction coefficient KCN and possible-update hot correction coefficient KCP1, KCP2; K2 is a second proportion coefficient memorized in third calculating block 34; n is the number of rows and columns in the matrix defining hot correction map 40; Lmax is the maximum load in hot correction map 40; Lmin is the minimum load in hot correction map 40; Lc is the load relative to updated hot correction coefficient KCN; Lp is the load relative to possible-update hot correction coefficient $KCP_1$, KCP2; Ld is the actual distance, in engine 4 load values, between updated hot correction coefficient KCN and possible-update hot correction coefficient -KCP1, KCP2; and Lm is the mean distance, in engine 4 load values, between the current hot correction coefficients KCO memorized in hot correction map 40.

For each of the possible-update hot correction coefficients KCP1, KCP2 arranged obliquely with respect to updated hot correction coefficient KCN:

$$\begin{cases} KPO(i,\ j) = K3 \cdot KT(i,\ j) \cdot \dfrac{Dm}{Dd} \\ Nd = Nc - Np \\ Ld = Lc - Lp \\ Dd = \max(Nd,\ Ld) \cdot \sqrt{2} \\ Dm = \dfrac{(N,\ L)\max - (L,\ N)\min}{n-1} \end{cases} \quad 3)$$

where KPO(i,j) represents the propagation coefficient between the updated hot correction coefficient KCN having an engine state flag IS of value "i", and the possible-update hot correction coefficient KCP1, KCP2 having an engine state flag IS of value "j"; KT(i,j) is the transition coefficient between updated hot correction coefficient KCN and possible-update hot correction coefficient KCP1, KCP2; K3 is a third proportion coefficient memorized in third calculating block 34; n is the number of rows and columns in the matrix defining hot correction map 40; Nc is the engine speed relative to updated hot correction coefficient KCN; Np is the engine speed relative to possible-update hot correction coefficient KCP1, KCP2; Lc is the load relative to updated hot correction coefficient KCN; Lp is the load relative to possible-update hot correction coefficient KCP1, KCP2; Nd is the actual distance, in engine speed, between updated hot correction coefficient KCN and possible-update hot correction coefficient KCP1, KCP2; Ld is the actual distance, in engine 4 load values, between updated hot correction coefficient KCN and possible-update hot correction coefficient KCP1, KCP2; and Dm is the mean distance between the current hot correction coefficients KCO memorized in hot correction map 40, in engine speed values if Nd is greater than Ld, and in engine 4 load values if Ld is greater than Nd.

In fact, as can be seen in equation 3), Dd is proportional to the actual distance between updated hot correction coefficient KCN and possible-update hot correction coefficient KCP1, KCP2, expressed in engine speed or in engine 4 load values, depending on which of the two distances is greater, so that Dm must consistently represent the respective mean distance between the current hot correction coefficients KCO memorized in hot correction map 40.

Block 220 then goes on to a block 230, in which third calculating block 34 calculates new hot correction coefficients to substitute for possible-update hot correction coefficients $KCP_1$, KCP2 having engine state flag IS values of other than five—hereinafter referred to as "substitute hot correction coefficients" KCM1 and KCM2—by multiplying the possible-update hot correction coefficients KCP1, KCP2 memorized in hot correction map 40 by the respective propagation coefficients calculated in block 220.

Block 230 then goes on to a block 240, in which third calculating block 34 calculates new substitute hot correction coefficients for possible-update hot correction coefficients KCP1, KCP2 having engine state flag IS values of five. More specifically, each of the possible-update hot correction coefficients KCP1, KCP2 in the same row as updated hot correction coefficient KCN and having engine state flag IS value of five is made equal to the preceding current hot correction coefficient KCO (preceding in the increasing engine speed direction) located in the same row and having an engine state flag IS value of other than five.

The same also applies to possible-update hot correction coefficients KCP1, KCP2 arranged obliquely with respect to updated hot correction coefficient KCN and having engine state flag IS values of five, and to possible-update hot correction coefficients KCP1, KCP2 located in the same column as updated hot correction coefficient KCN and having engine state flag IS values of five.

Alternatively, each of the possible-update hot correction coefficients KCP1, KCP2 located in the same column as updated hot correction coefficient KCN and having engine state flag IS values of five could also be determined by effecting a linear interpolation of the two preceding current hot correction coefficients KCO (preceding in the increasing load value direction) located in the same column and having engine state flag IS values of other than five.

Block 240 then goes on to a block 250, in which third calculating block 34 determines, from among possible-update hot correction coefficients KCP1, KCP2, actual-update hot correction coefficients KCE on the basis of a conditioning function ensuring development of hot correction map 40 according to a predetermined criterion.

More specifically, the conditioning function uses update state flags IA of possible-update coefficients KCP1, KCP2, and is defined by the following rules:

a) hot correction coefficients which have been updated directly, as opposed to via propagation, i.e. hot correction coefficients KC relative to update state flags IA of values greater than or equal to one, are only updated further directly, and not by propagation of other updates; and b) propagation of an update must not alter the "form" of hot correction map 40 about the updated hot correction coefficient KCN determined in block 150, i.e. propagation must not alter the existing relationship between the updated hot correction coefficient KCN and possible-update hot correction coefficients KCP1, KCP2.

More specifically, as regards rule b), for each possible-update hot correction coefficient KCP1, KCP2:

if the updated correction coefficient KCN is greater than the possible-update hot correction coefficient KCP1, KCP2 and propagation would increase the difference between the two even further, then propagation is not effected towards the possible-update hot correction coefficient KCP1, KCP2; and if propagation—should invert the existing relationship between the updated correction coefficient KCN and the possible-update correction coefficient KCP1, KCP2 (i.e. if the updated correction coefficient KCN is greater than the possible-update hot correction coefficient KCP1, KCP2, and propagation would result in an updated hot correction coefficient KCN which is less than possible-updated correction coefficient KCP1, KCP2, or vice versa), then the possible-update correction coefficient KCP1, KCP2 is made equal to the updated hot correction coefficient KCN.

Block 250 then goes on to a block 260, in which third calculating block 34 updates and memorizes hot correction map 40 in memory block 36, by replacing the memorized actual-update hot correction coefficients KCE with the respective substitute hot correction coefficients KCM1, KCM2, KCM3, KCM4 determined in blocks 230 and 240.

Block 260 then goes on to a block 270, in which third calculating block 34 updates and memorizes update state map 46 in memory block 36 according to the updates made in block 260 and the update criterion described below with reference to the state diagram in FIG. 7.

Updating terminates once update state map 46 has been updated, and recommences upon the conditions described above with reference to block 100 being determined once more.

For the sake of simplicity, updating of update state map 46 is described below with reference to only one update state flag.

To begin with, all the update state flags IA of update state map 46 assume a zero value (IA=0) indicating the relative current hot correction coefficients KCO have never been updated, as, for example, at the initial calibration stage of engine 4.

Figure 7:
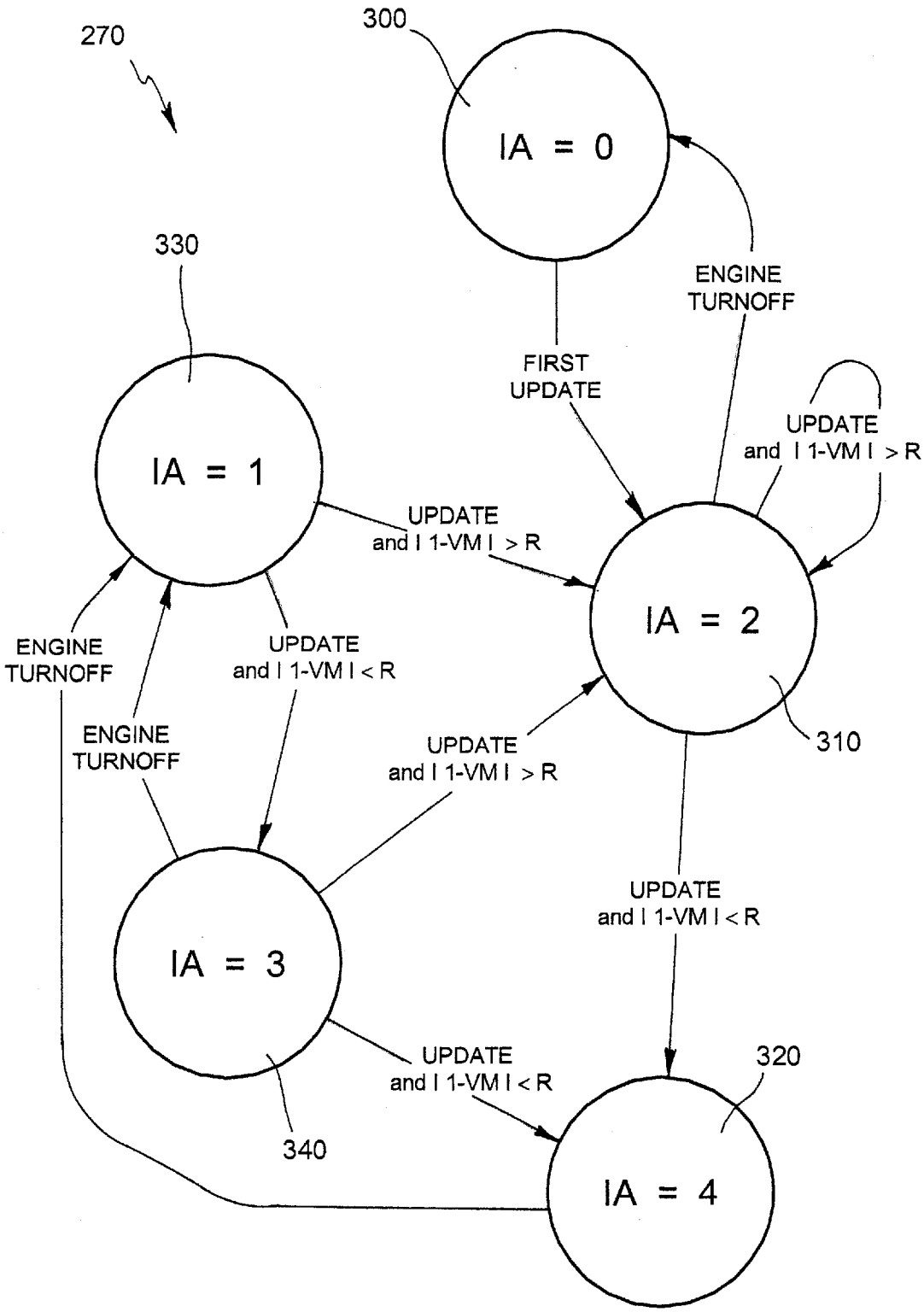
FIG. 7 shows a state diagram defining a criterion for updating an update state map.

As shown in FIG. 7, from state IA=0 (block 300), IA assumes a value of 2 (block 310) when the first update is made to the relative current hot correction coefficient KCO, and this value is maintained as long as the relative current hot correction coefficient KCO is updated in the presence of condition $|1-VM|>R$.

As of state IA=2 (block 310), IA assumes a value of 4 (block 320) if the current hot correction coefficient KCO is updated in the presence of condition $|1-VM|<R$, or assumes a zero value (block 300) if engine 4 is turned off.

As of state IA=4, IA assumes a value of 1 (block 330) if the engine is turned off.

As of state IA=1 (block 330), IA assumes a value of 2 (block 310) if the current hot correction coefficient KCO is updated in the presence of condition $|1-VM|>R$, or assumes a value of 3 (block 340) if the current hot correction coefficient KCO is updated in the presence of condition $|1-VM|<R$.

As of state IA=3 (block 340), IA assumes a value of 2 (block 310) if the current hot correction coefficient KCO is updated in the presence of condition $|1-VM|>R$, assumes a value of 4 (block 320) if the current hot correction coefficient KCO is updated in the presence of condition $|1-VM|<R$, or assumes a value of 1 (block 330) if engine 4 is turned off.

The advantages of the self-adapting control method according to the present invention will be clear from the foregoing description.

In particular, including a hot correction coefficient KC and cold correction coefficient KF in the fuel quantity computing chain, using the ratio information supplied by stoichiometric composition sensor 12, provides for compensating for production differences and ageing of engine 4 and injection system 2 by attributing the whole correction to the quantity of fuel injected as opposed to the actuation characteristic of the injectors.

As a result, compared with known control systems, the ratio is adapted much faster, by the update propagation procedure described above permitting updating of the hot and cold correction maps with far fewer direct updates of hot and cold correction coefficients KC, KF than those required in known ratio control systems to estimate the gain and offset of the injector actuation characteristic.

Moreover, the ratio control method according to the present invention provides for compensating, not only for linear errors due to production vibrations and ageing of the engine and injection system, but also for nonlinear errors, thus providing for more effective ratio correction.

Clearly, changes may be made to the control method as described and illustrated herein without, however, departing from the scope of the present invention.

What is claimed is:

1. A self-adapting method for controlling the mixture ratio of an injection system (2), of an internal combustion engine (4), comprising a number of injectors (18), each for injecting a respective operating quantity (QF) of fuel at each engine cycle; and a stoichiometric composition sensor (12) generating a composition signal (V) related to the stoichiometric composition of the exhaust gases produced by said engine (4); in each operating state of the engine (4) and for each said injector (18), said method comprising the steps of:

a) determining a nominal quantity (QA) of fuel to be injected;

b) determining an operating parameter (KO2) as a function of said composition signal (V) and of a proportional-integral regulating function;

c) determining a current hot correction coefficient (KCO) indicating a correction to be made to said nominal quantity (QA) of fuel to take into account the effect on injection of deviation of said engine (4) and said injection system (2) from nominal values thereof upon the engine (4) reaching normal operating temperatures; and d) determining said operating quantity (QF) of fuel to be injected as a function of said nominal quantity (QA), of said operating parameter (KO2), and of said current hot correction coefficient (KCO).

2. A method as claimed in claim 1, for an injection system controlled by a central control unit (20) in which is memorized a hot correction map (40) containing a respective said current hot correction coefficient (KCO) for each operating state of the engine (4) defined by a respective pair of values of the speed (N) and load (L) of the engine (4); comprising the step of:

e) updating said hot correction map (40) for each operating state based on said respective pair of values.

3. A method as claimed in claim 2, wherein said step e) comprises, for an operating state of the engine (4), the step of:

e1) updating the current hot correction coefficient (KCO) relative to said operating state of the engine (4) as a function of a number of values assumed by said operating parameter (KO2) in preceding engine cycles.

4. A method as claimed in claim 3, wherein said step e1) comprises the step of updating the current hot correction coefficient (KCO) relative to said operating state of the engine (4) as a function of a quantity related to a mean value of said number of values assumed by said operating parameter (KO2).

5. A method as claimed in claim 3, wherein said step e1) comprises the steps of:

e11) determining an updated hot correction coefficient (KCN) as a function of the current hot correction coefficient (KCO) memorized in said hot correction map (40) and relative to said operating state of the engine (4), and of said quantity, related to the mean value of said operating parameter (KO2); and e12) memorizing said updated hot correction coefficient (KCN) in said hot correction map (40) in place of said current hot correction coefficient (KCO).

6. A method as claimed in claim 5, wherein said step e) also comprises, for an operating state of said engine (4), the step of:

e2) propagating the update made in said step e1) to further current hot correction coefficients (KCO) memorized in said hot correction map (40).

7. A method as claimed in claim 6, wherein said step e2) comprises the steps of:

e21) determining possible-update hot correction coefficients (KCP1, KCP2) in said hot correction map (40);

e22) determining propagation coefficients (KPN, KPL, KPO) indicating the extent by which the update of said updated hot correction coefficient (KCN) is propagated to said possible-update hot correction coefficients (KCP1, KCP2);

e23) determining a respective substitute hot correction coefficient (KCM3, KCM4) for each of the possible-update hot correction coefficients (KCP1, KCP2); and e24) updating said hot correction map (40) as a function of said substitute hot correction coefficients (KCM3, KCM4).

8. A method as claimed in claim 7, wherein said step e21) comprises the step of:

e211) determining, from the current hot correction coefficients (KCO) memorized in said hot correction map (40), first possible-update hot correction coefficients (KCP1) located at a distance of one from said updated hot correction coefficient (KCN) and defining a first frame of hot correction coefficients about said updated hot correction coefficient (KCN).

9. A method as claimed in claim 8, wherein said step e21) also comprises the step of:

e212) determining, from the current hot correction coefficients (KCO) memorized in said hot correction map (40), second possible-update hot correction coefficients (KCP2) located at a distance of two from said updated hot correction coefficient (KCN) and defining a second frame of hot correction coefficients about said first frame.

10. A method as claimed in claim 7, wherein said step e24) comprises the step of:

e241) determining, from said possible-update hot correction coefficients (KCP1, KCP2), actual-update hot correction coefficients (KCE) on the basis of a conditioning function ensuring development of said hot correction map (40) according to a predetermined development criterion.

11. A method as claimed in claim 10, wherein said development criterion is defined by the following conditions:

current hot correction coefficients (KCO) which have been updated directly, as opposed to via propagation, are only updated further directly, and not by propagation of other updates; and propagation of an update must not alter the existing relationship between the updated hot correction coefficient (KCN) and the possible-update hot correction coefficients (KCP1, KCP2).

12. A method as claimed in claim 2, also comprising the step of performing said step e) in predetermined operating conditions of said engine (4) and said injection system (2).

13. A method as claimed in claim 1, also comprising the step of:

f) determining a current cold correction coefficient (KFO) indicating a correction to be made to said nominal quantity (QA) of fuel to be injected, to take into account the effect of low temperatures on injection;

and, in said step c), said operating quantity (QF) of fuel is also determined as a function of said current cold correction coefficient (KFO).

14. A method as claimed in claim 13, for an injection system controlled by a central control unit (20) in which is memorized a cold correction map (42) containing a respective said current cold correction coefficient (KFO) for each operating state of the engine (4) defined by a respective pair of values of a cooling water temperature (THO2) and the pressure (PC) in an intake manifold (14) of the engine (4); also comprising the step of:

g) updating said cold correction map (42).

15. A method as claimed in claim 14, wherein said step g) comprises, for an operating state of the engine (4), the step of:

g1) updating the current cold correction coefficient (KFO) relative to said operating state of the engine (4) as a function of a number of values assumed by said operating parameter (KO2).

16. A method as claimed in claim 15, wherein said step g1) comprises the step of updating the current cold correction coefficient (KFO) relative to said operating state of the engine (4) as a function of the mean value of the values assumed by said operating parameter (KO2) in a predetermined time window.

17. A method as claimed in claim 15, wherein said step g1) comprises the steps of:

g11) determining an updated cold correction coefficient (KFN) as a function of the current cold correction coefficient (KFO) memorized in said cold correction map (42) and relative to said operating state of the engine (4), and of said quantity related to the mean value of said operating parameter (KO2); and g12) memorizing said updated cold correction coefficient (KFN) in said cold correction map (42) in place of said current cold correction coefficient (KFO).

18. In a self-adapting method for controlling an air/fuel mixture of a fuel injection system of an internal combustion engine having a number of injectors, each for injecting a respective operating quantity of fuel during each engine cycle; and a stoichiometric composition sensor generating a composition signal related to the stoichiometric composition of the exhaust gases produced by said engine; and wherein in each operating state of the engine and for each said injector, a nominal quantity of fuel to be injected is determined from said composition signal and a program related thereto and an operating parameter acts on said nominal quantity of fuel to be injected, the improvement for compensating for differences in properties of the engine and the injection system due to production and ageing thereof, comprising the steps of determining hot and cold current correction coefficients, selectively applying said hot and cold current correction signals to said operating parameter, depending on engine temperature, to obtain an operating quantity of fuel to be injected by said fuel injectors, correlated for the respective engine and injection system, and updating said current hot and cold correction coefficients by correction maps stored in a memory and supplied by respective pairs of parameters related to the operation state of the engine said correction maps including first and second electronic maps for respectively producing said current hot and cold correction coefficients depending on operation states of the engine, a third electronic map indicating engine state for operating states of the engine, a fourth electronic map providing update states for operating states of the engine, and a fifth electronic map providing a number of transition coefficients as a function of engine state provided by the third electronic map, said electronic maps being defined by two dimensional matrixes each having the same number of rows and columns, the first, third and fourth electronic maps relating parameters of engine speed and load, the second and fifth electronic maps relating parameters of coolant temperature and intake manifold air pressure, and achieving said updating of the current hot and cold correction coefficients from the third, fourth and fifth electronic maps as said third, fourth and fifth electronic maps are updated by the state of engine operation.

19. The method as claimed in claim 18, comprising updating the first and second electronic maps by continually measuring the updated correction coefficients therein.

* * * * *